US006263796B1

(12) United States Patent
Jordan

(10) Patent No.: US 6,263,796 B1
(45) Date of Patent: Jul. 24, 2001

(54) CLOSED LOOP CONTROL FOR AN IMAGE TRANSFER SECTION OF A PRINTER

(75) Inventor: James M. Jordan, Eagan, MN (US)

(73) Assignee: Datacard Corporation, Minneapolis, MN (US)

( * ) Notice: Subject to any disclaimer, the term of this patent is extended or adjusted under 35 U.S.C. 154(b) by 0 days.

(21) Appl. No.: 08/997,439

(22) Filed: Dec. 23, 1997

(51) Int. Cl.[7] ..... B41L 3/02
(52) U.S. Cl. ..... 101/486; 101/33; 101/34
(58) Field of Search ..... 101/27, 33, 34, 101/35, 37, 43, 44, 485, 486; 400/120.01, 175, 703, 708

(56) References Cited

U.S. PATENT DOCUMENTS

| | | | | |
|---|---|---|---|---|
| 3,657,051 | | 4/1972 | McCarthy . | |
| 4,179,210 | | 12/1979 | Bestenreiner et al. . | |
| 4,438,696 | | 3/1984 | George et al. . | |
| 4,495,507 | | 1/1985 | Moriguchi et al. . | |
| 4,542,387 | * | 9/1985 | Nagashima et al. | 400/120 |
| 4,594,597 | | 6/1986 | Lin et al. . | |
| 4,694,305 | | 9/1987 | Shiomii et al. . | |
| 4,707,706 | | 11/1987 | Nagano . | |
| 4,857,941 | | 8/1989 | Kaida . | |
| 4,863,297 | | 9/1989 | Fujii . | |
| 4,972,772 | * | 11/1990 | Samejima et al. | 101/37 |
| 5,037,216 | | 8/1991 | Nubson et al. . | |
| 5,134,931 | * | 8/1992 | Thompson et al. | 101/27 |
| 5,189,477 | | 2/1993 | Leys et al. . | |
| 5,250,133 | | 10/1993 | Kawamura et al. . | |
| 5,440,328 | | 8/1995 | Nardone et al. . | |
| 5,528,277 | | 6/1996 | Nardone et al. . | |
| 5,546,115 | | 8/1996 | Nardone et al. . | |
| 5,546,116 | | 8/1996 | Nardone et al. . | |
| 5,600,362 | | 2/1997 | Morgavi et al. . | |
| 5,610,649 | | 3/1997 | Kokubo . | |
| 5,685,220 | * | 11/1997 | Steffen et al. | 101/37 |

FOREIGN PATENT DOCUMENTS

| | | |
|---|---|---|
| 195 43 099 A1 | 5/1997 | (DE) . |
| 2 699 857 | 7/1994 | (FR) . |
| 08066999 | 3/1996 | (JP) . |

OTHER PUBLICATIONS

"An Introduction to Digital Color Printing", AGFA Education Publishing, pp. 2–5, Sep. 1996.

* cited by examiner

*Primary Examiner*—Ren Yan
(74) *Attorney, Agent, or Firm*—Merchant & Gould PC

(57) ABSTRACT

The present invention provides an image transfer section of a printer having a control system controlling the operation thereof, as well as a control system and method for controlling the operation of the image transfer section. In particular, the control system and method of the present invention ensures that horizontal and vertical registration of the card and web is attained. The control is adaptive, so as to automatically adjust to differing speeds and gear drives of the independent systems. The control system of the present invention also automatically adjusts the speed of the web take-up roll and the card drive rollers so as to match the speed of the applicator rollers, thereby eliminating the need for slip clutches in the various systems as well as guaranteeing speed matches between the independent systems. Further, since the receptor web has a plurality of horizontally spaced images printed thereon, the control system of the present invention is designed to ensure that the proper image is transferred onto the card.

29 Claims, 5 Drawing Sheets

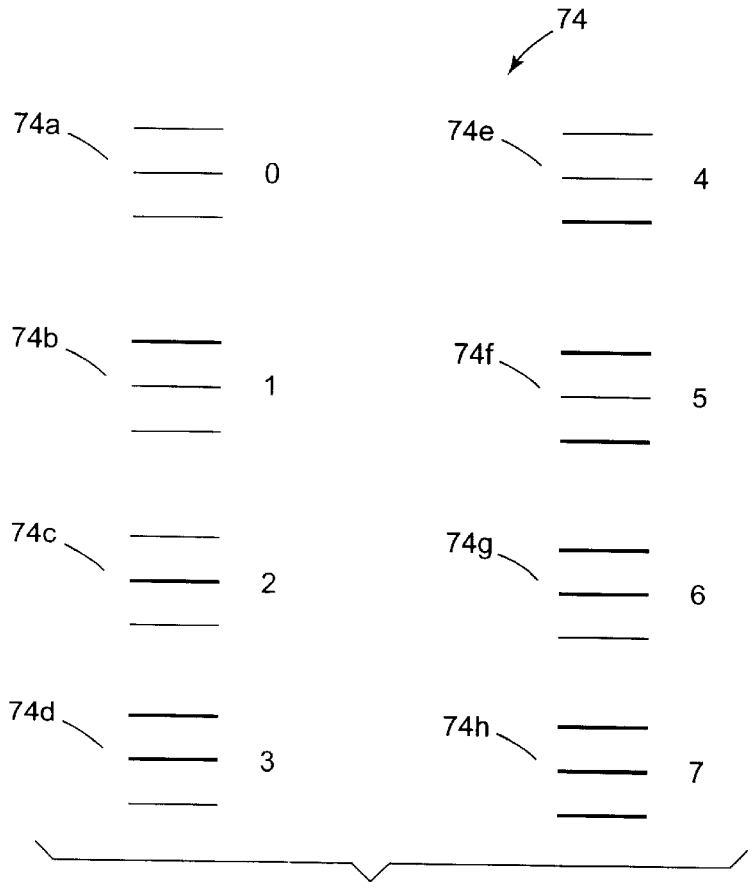
Fig. 7
Fig. 8
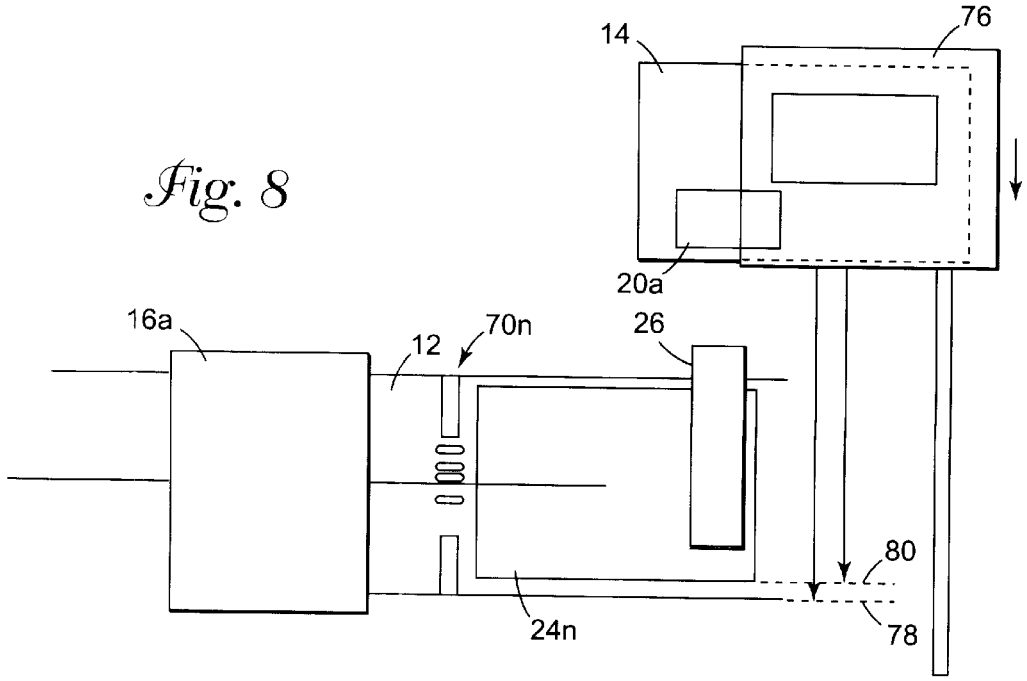

CLOSED LOOP CONTROL FOR AN IMAGE TRANSFER SECTION OF A PRINTER

FIELD OF THE INVENTION

This invention relates to printers of the type having image transfer sections that transfer a printed image from a receptor web onto a plastic card, such as credit cards, identification cards and the like, and more particularly to a control system and method for controlling the operation of the image transfer section of such a printer.

BACKGROUND OF THE INVENTION

One of the basic requirements in an automated control system is to coordinate the activity of multiple independent mechanical systems in real time. Often, the independent mechanical systems must be orchestrated in such a maimer that the motions of several of the systems are required to culminate at the same time, even though each system is driven through different methods, speeds and/or gear ratios. This is difficult to accomplish in a system where one or more of the drive component systems operate at variable speeds.

An image transfer section of a printer is one example of multiple mechanical systems that must be controlled in a precise manner in order to assure accurate transfer of the image onto the card. Typically an image transfer section includes a pair of applicator rollers forming a roller nip, with one of the applicator rollers being heated. A plastic card and a receptor web pass through the nip to laminate a portion of the receptor web onto the card. The portion of the receptor web that is laminated onto the card has an image printed thereon, and therefore the printed image is transferred from the receptor web onto the plastic card. The applicator rollers are each driven in opposite directions through a suitable connection to a drive motor, and one of the applicator rollers is moveable toward and away from the other applicator roller, thereby varying the gap between the applicator rollers. The plastic card is driven into the nip of the applicator rollers by a pair of drive rollers which are driven in opposite directions by a drive motor, and the receptor web is pulled through the nip of the applicator rollers by a web take-up roll which is driven by another drive motor. In this system, an image is first printed onto the receptor web in a printing station, and the image is then transferred onto the card by the applicator rollers.

One of the primary problems associated with an image transfer section is the requirement to register the card, the applicator rollers and the receptor web in the horizontal direction (X-axis direction) and to register the card and web in the vertical direction (Y-axis direction), in order to assure proper transfer of the image to the card. Horizontal registration involves controlling the three independent systems so that the card and the desired printed image on the receptor web reach the nip of the applicator rollers simultaneously with the moveable applicator roller reaching its application position, thereby assuring that the printed image will be properly located horizontally on the card. Vertical registration involves controlling the relative vertical positions of the card and receptor web such that the printed image will be properly located vertically on the card.

Since card transport devices in a printer are typically driven with stepper motors, horizontal registration is usually accomplished in an open loop system, where the card is transported (or stepped) a predetermined number of steps where, on completion of the steps, the card is assumed to be properly located relative to the applicator rollers and the receptor web. The receptor web is also driven by an independent stepper motor, where on completion of a predetermined number of steps, the receptor web is assumed to be properly located relative to the card and the applicator rollers. The moveable applicator roller, as stated above, is also required to position itself prior to beginning the transfer of the image onto the card. The moveable applicator roller is also positioned using an independent stepper motor which drives the moveable applicator roller toward the other applicator roller a predetermined number of steps, such that upon completion of the steps, the moveable roller is assumed to be registered with the card and receptor web. Typically, the card and web are first driven into position and then stopped, waiting for the applicator roller to be driven into position so that the image transfer function can begin.

This method results in several problems however, such as card slippage due to having to stop and restart the stepper motor driving the card drive rollers. The receptor web is also liable to cut, slip or melt due to waiting for the registration to be completed before beginning the image transfer function. Further, an image transfer section such as this will experience problems when a component in any one of the systems requires replacement.

Further, vertical registration is difficult due to web tracking variances, since the receptor web may drift in the vertical direction. Therefore, either the card or the receptor web must be adjusted to match the vertical location of the image with the card. Further, since the plastic card and the image(s) printed on the receptor web are produced independent of each other, there is no correlation between the two mediums. A plastic card that is to be personalized with unique data, such as customer data, must be matched with the proper image that is printed on the receptor web. Failure to properly match the card with the correct printed image will result in, at best, card production errors, and at worst, the customer receiving the wrong card and/or the wrong personalized data.

Another problem faced by an image transfer section is the requirement to match the speed of the moving card with the speed of the applicator rollers and the speed of the receptor web. The independently driven systems must not overdrive the controlling critical element, in this case the applicator rollers, while the image transfer function is being performed, otherwise wrinkles, voids, "chatter", etc. may appear in the transferred image, or even worse receptor web breakage, card jams and the like may occur. Therefore, the card and the receptor web must be driven at the same speed as the applicator rollers. Typically, the card drive rollers and the web take-up roll are clutched, while the card and receptor web motions are controlled by the applicator rollers pinching the card and web, which allows the systems to be overdriven while avoiding the problems mentioned previously. However, since the applicator rollers are typically driven by a DC motor, the rotational speed thereof will vary due to the load (pressure) on the applicator rollers as they press together. The DC motor may also vary rotational speed due to the amount of current allowed to the motor under control of the microprocessor connected thereto.

What is needed then is a control system and method for an image transfer section that ensures horizontal and vertical registration, adjusts the speed of the web take-up roll and the card drive rollers to match the rotational speed of the applicator rollers, and ensures that the correct image is transferred onto the card.

SUMMARY OF THE INVENTION

The present invention provides an image transfer section of a printer having a control system controlling the operation thereof, as well as a control system and method for controlling the operation of the image transfer section. In particular, the control system and method of the present invention ensures that the movements of the independent systems forming the image transfer section are completed simultaneously, thereby assuring horizontal registration between the card, web, and the applicator rollers. The control is adaptive, so as to automatically adjust to differing speeds and gear drives of the independent systems. The control system and method of the present invention also automatically adjusts the speed of the web take-up roll and the card drive rollers so as to match the speed of the applicator rollers, thereby eliminating the need for slip clutches in the various systems as well as guaranteeing speed matches between the independent systems. Further, since the receptor web has a plurality of horizontally spaced images printed thereon and may at times move vertically, the control system of the present invention is designed to ensure that the proper image is transferred onto the card, as well as ensuring vertical registration between the card and the receptor web so that the transferred image is properly located on the card.

A preferred embodiment of the image transfer section in accordance with the principles of the present invention includes first and second applicator rollers forming a roller nip therebetween, with the first applicator roller being moveable toward and away from the second applicator roller between a first position adjacent the second applicator roller to thereby form the roller nip and a second position remote from the second applicator roller. A pair of rotatable drive rollers are disposed upstream of the applicator rollers to drive a plastic card into the roller nip of the first and second applicator rollers, and a rotatable receptor web take-up roll disposed downstream of the applicator rollers pulls a receptor web between the applicator rollers. A control system is provided to control the applicator rollers, drive rollers, and web take-up roll.

The control system includes an adaptive horizontal registration control means controlling the movement of the first application roller between the first position and the second position, and controlling the drive rollers and the web take-up roll so that the card and printed image are driven into the roller nip substantially simultaneously with the first applicator roller reaching the first position, thereby ensuring proper horizontal registration of the image on the card. Since the horizontal registration control means is adaptive, it will automatically adjust to differing speeds and gear trains associated with the applicator rollers, drive rollers and web take-up roll. The control system also ensures proper vertical registration of the image and the card, as well as correlating the card with the correct image on the receptor web.

The control system also includes adaptive speed adjustment control means controlling the speed of rotation of the pair of drive rollers arid the web take-up roll so as to substantially equal the speed of rotation of the first and second applicator rollers. The adaptive speed adjustment control means eliminates the need for slip clutches in the image transfer section, as well as ensuring that the rotational speeds of the applicator rollers, drive rollers, and web take-up roll match.

These and various other advantages and features of novelty which characterize the invention are pointed out with particularity in the claims annexed hereto and forming a part hereof. However, for a better understanding of the invention, its advantages and objects attained by its use, reference should be made to the drawings which form a further part hereof, and to the accompanying description, in which there is described a preferred embodiment of the invention.

BRIEF DESCRIPTION OF THE DRAWINGS

FIG. 7 illustrates the sequencing bar codes used in the present invention.

FIG. 8 is a side view of a portion of the image transfer section, illustrating how the card and the receptor web are vertically registered.

DETAILED DESCRIPTION OF THE PREFERRED EMBODIMENT

Figure 1:
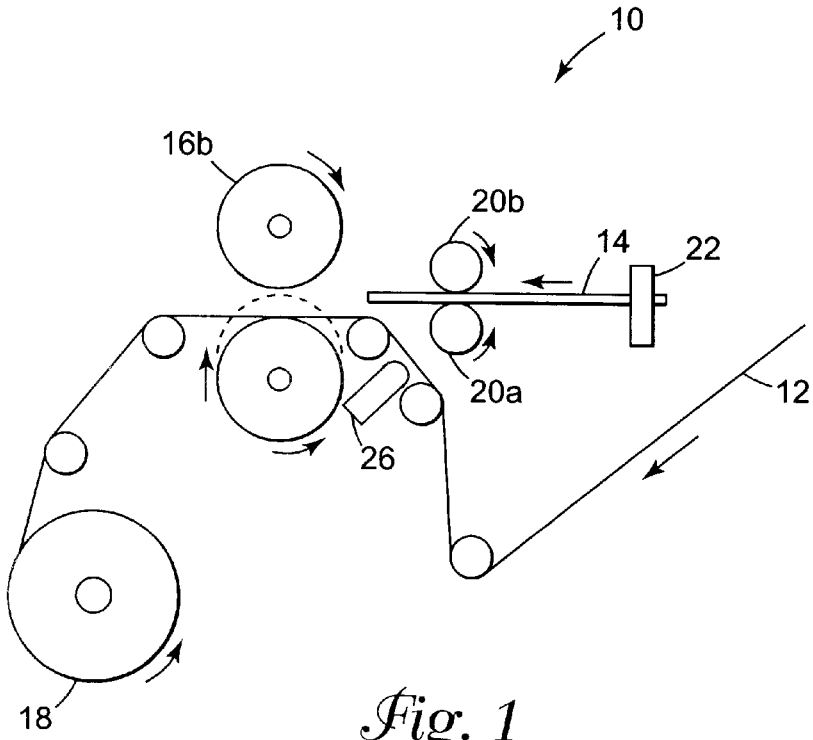
FIG. 1 illustrates an image transfer section of a printer, which is controlled using the control system of the present invention.
Figure 1A:
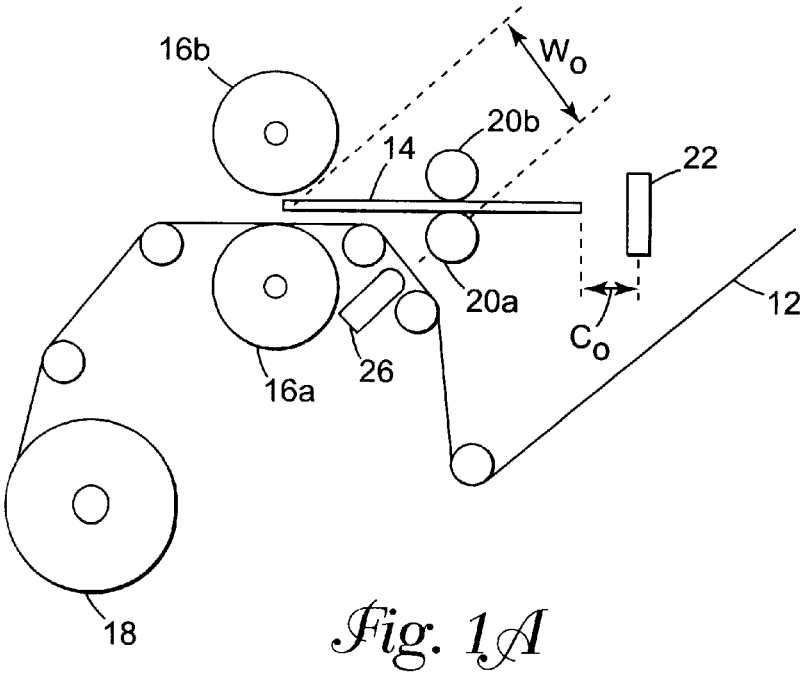
FIG. 1A is a view similar to FIG. 1, but showing the card positioned in the nip of the applicator rollers.
Figure 4:
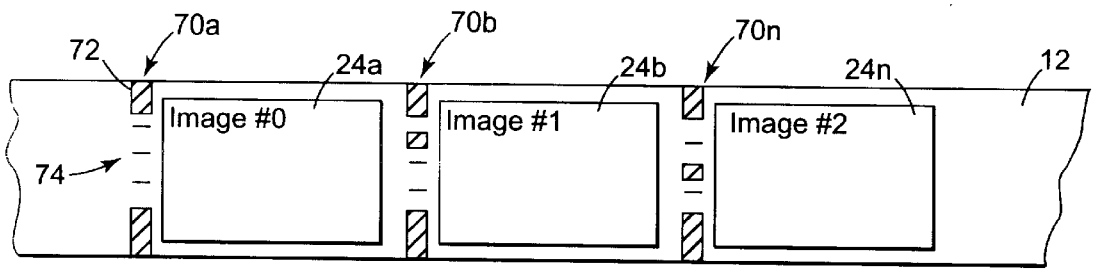
FIG. 4 is a side view of a portion of the receptor web with a plurality of images printed thereon, and registration marks and sequencing bar codes adjacent the leading edges of the printed images.

With reference now to FIGS. 1 and 1A, an image transfer section 10 of a printer is illustrated, which transfers one image from a receptor web 12 onto a plastic card 14, such as a credit card, identification card or the like, by mating the card with the receptor web and causing transfer of the image to the card, such as by thermal transfer, by laminating a layer of the receptor web containing the printed image onto the card. Receptor web materials and the process for laminating a layer of the web onto a plastic card are known in the art, and are therefore not described herein in detail. The receptor web 12 includes a plurality of horizontally spaced images 24*a,b* . . .n printed thereon (see FIG. 4) using a printing station, such as a color printer station, located upstream of the image transfer section. Further, the card 14 is transported within the printer to the image transfer section 10 in known fashion, with the card being properly oriented when reaching the image transfer section 10 such that when mated with the receptor web, the image will be transferred onto the desired side of the card.

The image transfer section 10 includes a pair of applicator rollers 16*a*,16*b* that are rotatable about the central axes thereof. The rollers 16*a,b* are rotatably driven in opposite directions at the same speed through a suitable connection to a DC drive motor (not shown). Preferably, the roller 16*a* is heated and the roller 16*b* is unheated, and the roller 16*a* is further mounted so as to be moveable towards and away from the roller 16*b* between a first position, in which the roller 16*a* is disposed adjacent the roller 16*b* (shown in dashed lines in FIG. 1), and a second position, in which the roller 16*a* is remote from the roller 16*b* (shown in solid lines in FIG. 1). The roller 16*a* is preferably driven to the first position by a stepper motor (not shown). In the first position of the roller 16*a*, a roller nip is formed between the rollers 16*a,b* with the receptor web 12 and the card 14 passing through the roller nip, with the heated roller 16*a* pressing the receptor web 12 into contact with one side of the card 14 and the roller 16*b* pressing against the other side of the card.

The receptor web 12 is taken up onto a take-up roll 18 disposed downstream of the rollers 16*a,b*, with the roll 18 being rotatable in a desired direction through a suitable connection to a stepper motor (not shown), which is independent from the stepper motor which moves the roller 16*a*, to thereby pull the receptor web 12 through the nip between the rollers 16*a,b*. Further, a pair of drive rollers 20*a*,20*b* are disposed upstream of the rollers 16*a,b*, with the card extending between the drive rollers 20*a,b* such that the roller 20*a* engages one side of the card and the roller 20*b* engages the opposite side of the card. The rollers 20*a,b* are rotatable in opposite directions at the same speed through a suitable connection to a stepper motor (not shown) which is independent from the stepper motors of the roller 16*a* and the web take-up roll 18, such that when rotated, the rollers 20*a,b* drive the card 14 into the nip of the rollers 16*a,b*. A registration photocell 22 is mounted upstream of the drive rollers 20*a,b* to detect the presence of the card 14, thereby providing an input to the control system to be later described. The drive rollers 20*a,b* form part of an elevator mechanism (to be later described with regard to FIG. 8) for vertically lowering the card 14 during a process of vertically registering the card with the receptor web, as will be described later in the description.

As indicated previously, it is desirable for the card 14 and the web 12 to be driven so that the card and the desired image on the web reach the nip between the applicator rollers 16*a,b* at the same time that the roller 16*a* reaches the first position adjacent the second roller 16*b*. Therefore, a suitable control system must be provided to control the movement of the applicator roller 16*a* and to control the rotation of the drive rollers 20*a,b* and the web take-up roll 18 so that these events occur simultaneously.

Further, as is apparent from FIG. 1, the drive rollers 20*a,b* and the applicator roller 16*b* are each in driving engagement with the card 14, and the receptor web 12 is being pulled by the take-up roll 18 while in simultaneous engagement with the rotating applicator roller 16*a* and the moving card 12, during the image transfer process. Therefore, it is essential that the rotational speeds of the applicator rollers 16*a,b*, take-up roll 18, and drive rollers 20*a,b* be equalized, even though each system is independently driven by separate motors.

In accordance with the present invention, a control system is provided for controlling the operation of the applicator rollers 16*a,b*, the web take-up roll 18 and the drive rollers 20*a,b*. The control system includes an adaptive horizontal registration control algorithm 30 for ensuring that the card and the image on the web reach the nip of the applicator rollers at the same time that the applicator roller 16*a* reaches the first position, thereby ensuring horizontal registration of the image on the card. As explained previously, the drive rollers 20*a,b*, the web take-up roll 18 and the movement of the applicator roller 16*a* are each driven by independent stepper motors and corresponding gear trains. The stepper motors, are in turn, controlled using independent acceleration tables or profiles that dictate the stepping speed of each stepper motor. Since each drive system uses an independent gear train, different distances per step result. The adaptive registration control algorithm 30 normalizes the motion requirements of the card and web positioning, as well as the applicator roller positioning, to time, to perform each function.

Figure 2:
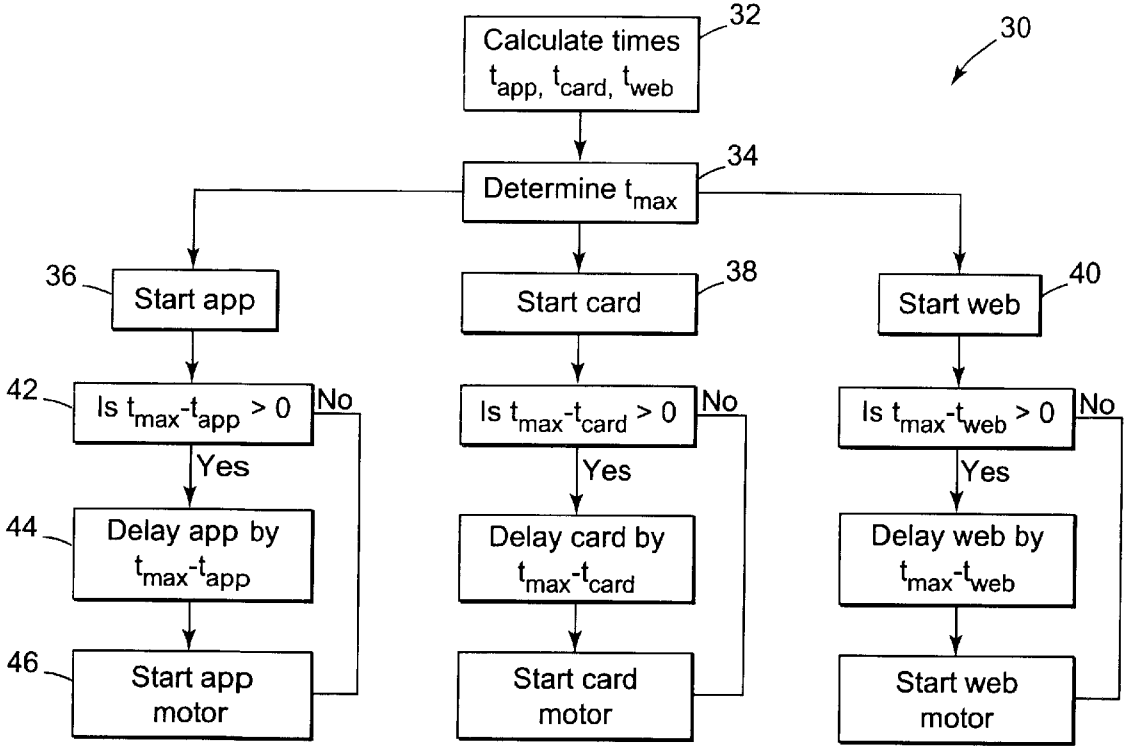
FIG. 2 is a diagram of the steps in the adaptive horizontal registration control algorithm, which forms a part of the control system for the image transfer section.

With reference to FIG. 2, it is seen that the control algorithm 30 includes the step 32 of calculating the time $t_{app}$ required to move the applicator roller 16*a* from the second position to the first position, calculating the time $t_{card}$ required to position the card into the nip of the applicator rollers, and the time $t_{web}$ required to position the image on the receptor web into the nip. Time is computed by summing the total time consumed by each stepper motor's acceleration and deceleration ramp times, plus the specified slew time multiplied by the slew steps. In particular, $t_{app}$, $t_{card}$, and $t_{web}$ are determined by the following equations:

$$t_{app}=\Sigma t_{app\ accel}+\Sigma t_{app\ decel}+(t_{app\ slew}\bullet S_{app}) \quad 1)$$

$$t_{card}=(\Sigma t_{card\ accel}+(t_{card\ slew}\bullet S_{card}))-t_k \quad 2)$$

$$t_{web}=\Sigma t_{web\ accel}+(t_{web\ slew}\bullet S_{web}) \quad 3)$$

where $t_{app\ accel}$, $t_{app\ decel}$, $t_{card\ accel}$, and $t_{web\ accel}$ are the acceleration and deceleration ramp times of the respective stepper motors;

$t_{app\ slew}$, $t_{card\ slew}$, and $t_{web\ slew}$ are the times that the respective stepper motors are driven at the desired, or slew, speed;

$S_{app}$, $S_{card}$, and $S_{web}$ are the number of motor steps taken by the respective stepper motors to achieve the desired position (not including the acceleration and deceleration motor steps); and $t_k$ is an adjustment factor.

The number of motor steps, $S_{app}$, $S_{card}$, and $S_{web}$ required to perform ach function are determined by the following equations:

$$S_{app}=(\text{roller offset distance}\div\text{distance per step of the application motor})-(\#\text{ of accel. motor steps}+\#\text{ of decel. motor steps}) \quad 4)$$

$$S_{card}=(\text{card offset distance}\div\text{distance per step of the drive roller motor})-\#\text{ of accel. motor steps} \quad 5)$$

$$S_{web}=(\text{web offset distance}\div\text{distance per step of the web take-up roll motor})-\#\text{ of accel. motor steps} \quad 6)$$

The roller offset distance is the distance the roller 16*a* moves when moving from the second position to the first position. The card offset distance is the distance the card moves to reach the nip from a predetermined starting position of the card, and the web offset distance is the distance the web moves so that the image reaches the nip. Each offset distance is preferably in 1/1000" increments. The card offset distance is illustrated in FIG. 1A as the distance $c_o$ between the trailing edge of the card and the photocell 22, which equals the distance between the leading edge of the card and the nip when the trailing edge of the card first starts exiting the photocell. The web offset, as shown in FIG. 1A, is defined as the distance, $w_o$, from a receptor web image sensor 26 to the nip of the applicator rollers 16*a,b*. Each offset distance will differ with each system, based on the total of mechanical tolerances. The offset values may also change based upon the card size (i.e. card thickness) and the size of the applicator rollers being used. It is to be noted that the deceleration ramp times of the drive roller stepper motor and web take-up roll stepper motor are not included in the time calculations for the card and web, or the step count for the card and web, since the card and web do not stop upon reaching the nip.

The adjustment factor $t_k$ accounts for the card thickness and the radius of the applicator rollers 16*a,b* due to the fact that the applicator rollers will actually begin driving the card 14 before the card reaches the nip of the applicator rollers because of the thickness of the card. The adjustment factor will, in effect, reduce the time required to transport the card into position. The adjustment factor is determined by the following:

$$t_k = (\text{nominal card thickness/distance per step of the drive roller motor}) \cdot t_{card\ slew} \quad 7)$$

where the nominal card thickness will vary based upon the type of card being used. For instance, one type of card which has particular use with the present invention has a nominal thickness of 0.030 inches.

Once the times, $t_{app}$, $t_{card}$, and $t_{web}$, required to perform each function are determined, the algorithm 30 determines which function(s) should be initiated immediately and how long to delay the initiation of the other function(s). At step 34, the maximum time, $t_{max}$, of the times $t_{app}$, $t_{card}$, and $t_{web}$ is determined. The function which takes the largest amount of time to complete must be initiated prior to the functions that require less time to complete, in order for all the functions to be completed at the same time. Therefore, once $t_{max}$ is determined, the algorithm 30 performs three subroutines, start applicator roller subroutine 36, start card subroutine 38, and start web subroutine 40, to control the various functions. The subroutines 36,38,40 are similar to each other, and therefore only one subroutine will be described in detail, it being understood that the other subroutines operate using the respective times associated therewith.

The start applicator roller subroutine 36 initially determines at step 42 whether $t_{max}$ minus $t_{app}$ is greater than zero. If true (i.e. if the time to move the applicator roller to the first position does not take the largest amount of time) the subroutine goes to step 44 where the start of the motor which drives the moveable applicator roller is delayed by the amount of $t_{max}$ minus $t_{app}$. After the delay in step 44 is over, the subroutine 36 then goes to step 46 where the motor of the moveable applicator roller is started, to start the movement of the applicator roller. If the result of step 42 is false (i.e. the time to move the applicator roller to the first position takes the greatest amount of time, $t_{max}$ equals $t_{app}$), then the subroutine proceeds directly to step 46, because the movement of the applicator roller must be initiated immediately. The subroutines 38,40 determine the necessary delay, if any, to applied to the drive roller motor and/or the web take-up roll motor, to thus delay movement of the card and the web.

The algorithm 30 thus ensures that the card and the image on the web reach the nip at the same time that the moveable applicator roller 16*a* reaches the first position, thereby ensuring proper horizontal registration of the image on the card.

As mentioned previously, the receptor web image sensor 26 is provided to detect the presence of an image 24*a,b. . . n*, to thereby allow calculation of the time $t_{web}$ to move the detected image the distance $w_o$ to the nip of the applicator rollers. In order to detect an image, as well as to correlate the card with the correct printed image 24*a,b. . . n* on the receptor web 12, unique indexing marks are printed onto the receptor web by the printer at the time the images are printed onto the web, with the indexing marks being readable by the sensor 26.

With reference now to FIGS. 4–7, it can be seen that a unique indexing mark 70*a,b. . . n* for each image 24*a,b. . . n* is printed onto the receptor web 12, closely adjacent the leading edge of each image. The indexing marks 70*a,b. . . n* are detectable by the sensor 26 to provide an indication of when to start the time calculation $t_{web}$, as well as permitting vertical registration of the card and image and verifying that the correct image is about to be applied to the card. Each indexing mark includes a registration bar 72 as well as a bar code sequence number portion 74. The indexing marks are preferably printed onto the receptor web at a density of 300 dpi, and the web sensor 26 for reading the indexing marks preferably utilizes a 64-element CCD diode array and a laser light source to read the indexing marks, with the diode array providing a density of 200 dpi.

As the web 12 passes by the web sensor, the sensor 26 will continuously scan the web attempting to recognize an indexing mark. Since the web may move in the vertical direction while streaming past the sensor 26, a fuzzy logic algorithm is preferably used to provide the indexing mark recognition. Each time that a vertical scan (i.e. read) of the web is completed, the diode sensor status will be shifted and saved as the latest entry in a circular buffer containing the previous (i.e. historic) diode scans. Maintenance of a circular history of the diode sensors provides an image of the contents of the receptor web 12 in the horizontal direction. On completion of each scan, the latest diode scan will be evaluated to determine the probability that a web indexing mark is currently in front of the sensor diodes. If the probability is high enough, the historic (i.e. horizontal) diode scans will be evaluated to determine if the image is a web registration index mark. If it is determined that the image is likely to be an index mark, the sensor 26 will attempt to read and decode the contents of the sequencing bar code 74. A successful read and decode of the bar code will then result in a successful determination of the presence of a web indexing mark. Failure of any of the evaluations, or failure to decode the bar code, will result in the assumption that the index mark is not currently in front of the diode sensors. Continued failure to recognize and decode an indexing mark will result in a web registration error declared by the control system of the image transfer section 10.

Figure 5:
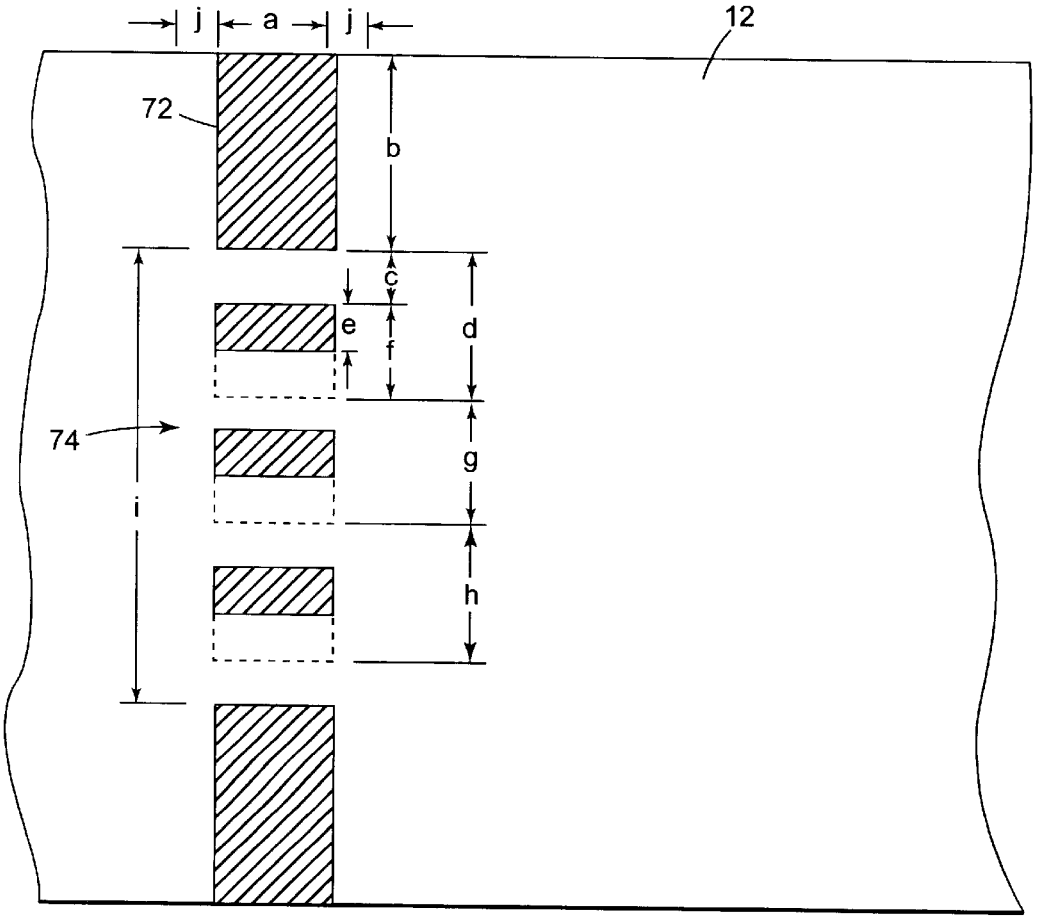
FIG. 5 is a detailed view of an exemplary indexing mark.

As illustrated in FIG. 5, the registration bar 72 and the bar code sequence number portion 74 are defined by a set of parameters a–j as set forth in the following table.

| Parameter | Description | # of print dots (@300 dpi) | # of diodes (@200 dpi) | dimension (inches) |
|---|---|---|---|---|
| a | Bar width | 15 | 10 | 0.05 |
| b | Vertical registration | 30 ± 15 | 20 ± 10 | 0.10 ± 0.05 |
| c | Quiet zone | 3 | 2 | 0.01 |
| d | Sequence # - bit 0 | 6 | 4 | 0.02 |
| e | Zero bit value | 3 | 2 | 0.01 |
| f | One bit value | 6 | 4 | 0.02 |
| g | Sequence # - bit 1 | 9 | 6 | 0.03 |
| h | Sequence # - bit 2 | 9 | 6 | 0.03 |
| i | Image sequence # | 27 | 18 | 0.09 |
| j | Leading/trailing quiet zones | 6 | 4 | 0.02 |

In the above table, the variance in the vertical registration provides the ability to adjust to a variable image position on the web, or a web that has some variance in the vertical plane as it travels. A vertical variance of ±0.05" is allowed.

Once an indexing mark is identified by the sensor 26, the time calculation, $t_{web}$, can then commence as described above, to ensure that the trailing edge of the registration bar 72 (which is effectively the leading edge of the image) reaches the nip simultaneously with the leading edge of the card, so that horizontal registration (X-axis) of the image and card is obtained. Preferably, the card and web image are registered to the nip of the applicator rollers in order to begin the image transfer as close to the leading edge of the card as possible. This process must be repeatable with as little variance as possible in the horizontal registration between the card and the image. However, the control system could control the various elements so that the image is horizontally registered to any location of the card, such that the image transfer begins at any horizontal location on the card.

The indexing marks also allow vertical registration to be achieved between the image and the card. The vertical (or Y-axis) registration will be determined by which diode in the diode array of the sensor 26 detects the beginning of the bar code sequence number portion 74 (parameter d in FIG. 5). The variance from the norm will determine the vertical offset to apply to the vertical location of the card. Vertical offset is defined as the distance that the card is lowered, relative to the receptor web 12, by an elevator mechanism 76 (see FIG. 8) which is used to lower the card 14, from an initial position of the elevator mechanism. Since the resolution of the sensor 26 is 200 dpi, the card will be adjusted by 1/200" (0.005") for each diode from the norm the indexing mark is detected.

As shown in FIG. 8, the elevator mechanism 76 is configured so as to be able to lower the card 14 and thus vertically position the card relative to the receptor web 12. Elevator mechanisms which are suitable for use with the present invention are generally known in the art, and therefore the details of the elevator mechanism 76 are not further described herein. As stated previously, the receptor web 12 has a nominal vertical position relative to the applicator rollers 16*a,b*, however the receptor web 12 may on occasion shift vertically relatively to the applicator rollers. Therefore, the elevator mechanism preferably lowers the card to a nominal offset level 78 when the receptor web is in its nominal position, as determined by the sensor 26, to thereby assure that the card is registered vertically relative to the image on the receptor web. However, since the web, and therefore the image, can shift vertically, the elevator mechanism 76 is preferably controllable so as to lower the card 14 either above or below the nominal level 78, for example to adjusted offset level 80, in order to vertically register the card and the image. Preferably the vertical registration between the card and receptor web is accomplished prior to the horizontal registration procedure.

As an example of the vertical registration, if the edge of the bar code sequence number portion is normally detected at diode #20 (see FIG. 6), the distance the card is lowered relative to the web 12 is determined by the configured offset distance between the initial position of the elevator mechanism 76 and the nominal offset level 78. If the edge of the sequence number portion is now detected at diode #30 (thus indicating that the web 12 has been vertically lowered relative to the sensor 26), the configured offset will be modified to lower the card another 10 diodes or 0.050" thereby ensuring registration between the card and the receptor web. If the edge is instead detected at diode #10 (thus indicating that the web is vertically displaced), the distance the card will be lowered to align it with the web will be adjusted by subtracting 0.050" from the nominal configured offset value. Thus, a total vertical adjustment range of 0.10" is provided.

Figure 6:
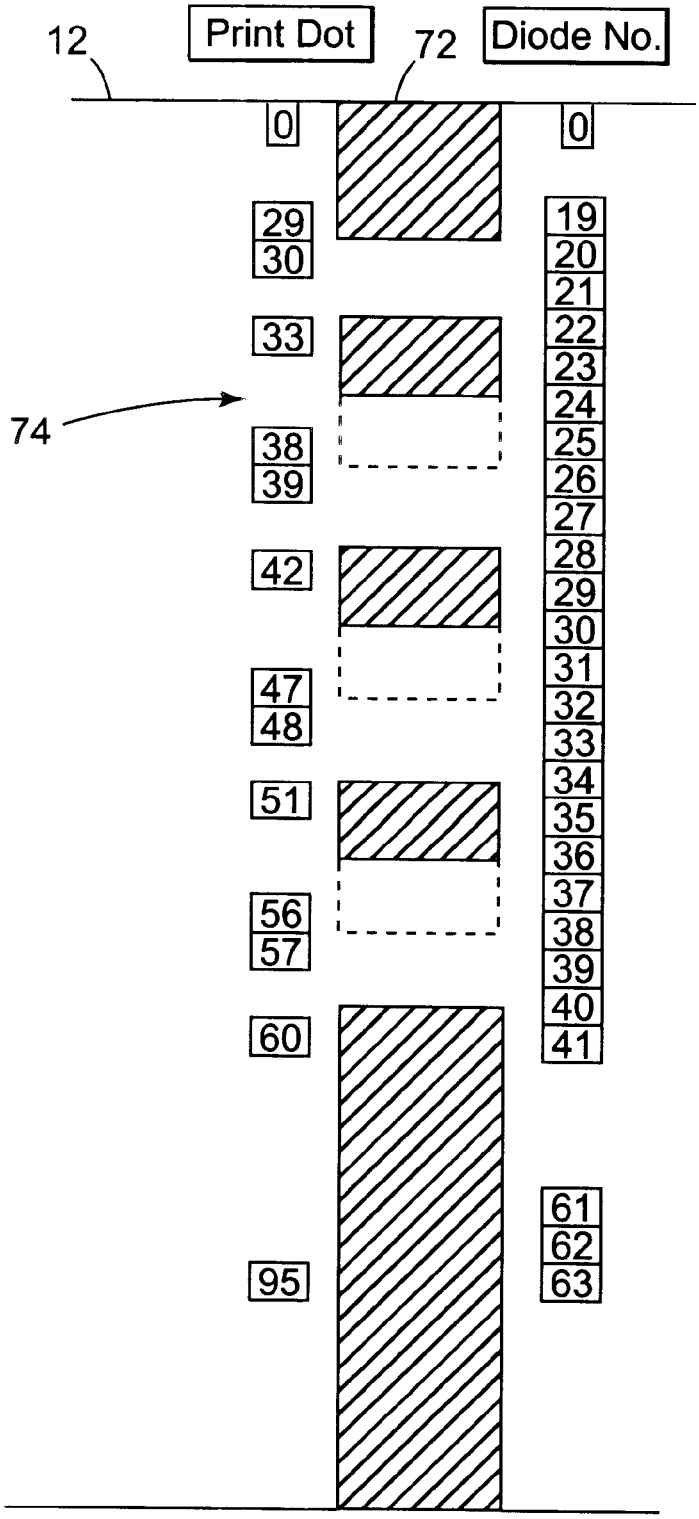
FIG. 6 is a view similar to FIG. 5, but showing the arrangement of the print dots and sensor diodes relative to the indexing mark.

FIG. 6 shows in detail the nominal values for the print dot values and the diode values that will read the index marks. The arrangement shown in FIG. 6 assumes that the diode array of the sensor 26 is aligned with the top of the web. In practice, the diode array could be aligned with any portion of the receptor web, in which case the print dot values become relative to the location of the first read diode (diode #0).

The bar code sequence number portion 74 of the indexing mark is a value from 0–7 which is assigned by the printing station prior to printing the respective image 24*a,b*. . . *n*, and as stated previously is used to correlate the card with the proper image. On issuing a command to the image transfer section 10 to receive a card 14 and transfer an image from the web onto the card, the sequence number value of the correct image to be applied will be specified to the control system. The image transfer section 10 will verify that the specified sequence number portion is the next image on the receptor web 12 (as determined by the sensor 26 decoding the sequence number portion), to thereby ensure that the correct image is applied to the correct card. A mismatch between the sequence number detected by the sensor 26, and the requested sequence number, will result in an error with no image transferred to the card. If the correct sequence number portion is identified by the sensor 26, the control system of the transfer section 10 will operate as described above to register the card with the image on the receptor web and transfer the image onto the card.

As illustrated in FIG. 7, a plurality of bar code sequencing number portions 74*a–h* are shown, with each bar code number portion being a simple, human readable 3-bit bar code encoding scheme having an assigned value of 0–7. The bar codes will always be printed so that bit 0 is disposed toward the top of the web, followed by bit 1, and ending with bit 2. A quite zone (non-printed zone) of at least 2 diodes (3 print dots at 300 dpi) is required between the bits, as well as before and after the entire bar code. This encoding system thus allows up to eight images to be queued waiting to be transferred onto the appropriate cards. However, other encoding schemes utilizing a larger or smaller number of sequencing number portions can be used if desired.

The control system for the image transfer section 10 further includes an adaptive speed adjustment algorithm 60 to equalize the rotational speeds of the applicator rollers 16*a,b*, take-up roll 18, and drive rollers 20*a,b*. The adaptive speed adjustment algorithm 60 commences after the registration algorithm 30 registers the card, web, and applicator rollers.

Figure 3:
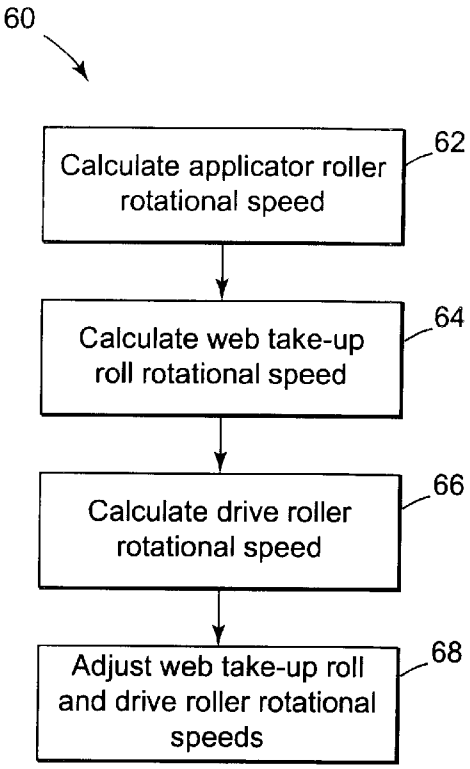
FIG. 3 is a diagram of the steps in the adaptive speed adjustment control algorithm, which forms a part of the control system for the image transfer section.

As illustrated in FIG. 3, the algorithm 60 initially calculates the rotational speed of the applicator rollers 16*a,b* at step 62. Rotational speed can be determined in any number of ways. For instance, a "chopper wheel" sensor can be mounted to the shaft that drives the roller 16*a*. Other means for determining the rotation speed of the applicator rollers 16*a,b* can be used as well. Once every second, the number of chopper wheel transitions are totaled, averaged, and converted into rotational speed using the formula:

$$\text{rotational speed} = \text{chopper count} \cdot (2\pi/40) \text{ linear inches per second.} \quad 8)$$

Once the rotational speed of the roller 16*a* is calculated, the proper rotational speeds of the web take-up roll 18 and the drive rollers 20*a,b* are calculated at steps 64 and 66, respectively, using the following equations:

$$\text{web take-up roll speed} = \text{rotational speed/distance per step of the web take-up roll stepper motor;} \quad 9)$$

$$\text{drive roller speed} = \text{rotational speed/distance per step of drive roller stepper motor.} \quad 10)$$

The distance per step of the stepper motors are the same values used in equations 5 and 6 above, and are constant based upon the particular stepper motor and gear train being utilized. For instance, in one configuration of the image transfer section, a distance per step of the web take-up roll stepper motor of 0.00474 and a distance per step of the drive roller stepper motor of 0.00404, have been used successfully. Once the web take-up roll speed and the drive roller speeds are determined, the algorithm adjusts the web take-up roll and the drive roller motors, at step 68, to equal the calculated speeds. In this manner, the speeds of the web take-up roll and the drive rollers are matched to the speed of the applicator rollers, thereby eliminating the need for slip clutches and eliminating wrinkles, voids, chatter, and the like due to mismatches in the speeds of the various elements.

The adaptive horizontal registration control algorithm and the adaptive speed adjustment algorithm can also be used in other printer systems, other than an image transfer section, where the operation of independent mechanisms must be controlled. For instance, adaptive algorithms similar to those described above can be used to control the operation of a printhead, print ribbon, and plastic cards, in a printer that prints directly onto the plastic cards.

It is to be understood that while certain embodiments of the present invention have been illustrated and described, the invention is not limited to the specific forms or arrangements of the parts described and shown. Instead, the invention resides in the claims hereinafter appended.

What is claimed is:

1. A method of controlling an image transfer section of a printer, the image transfer section including first and second rotatable applicator rollers forming a roller nip therebetween with the first applicator roller being moveable toward and away from the second applicator roller between a first position adjacent the second applicator roller and a second position remote from the second applicator roller, a pair of rotatable drive rollers to drive a card into the roller nip of the first and second applicator rollers, and a rotatable receptor web take-up roll having a receptor web connected thereto and extending between the applicator rollers, and a plurality of spaced images on the receptor web, the method comprising the step of:

controlling the movement of the first applicator roller from the second position to the first position and controlling the drive rollers and the web take-up roll so that the card and one of the images is driven into the roller nip substantially simultaneously with the first applicator roller reaching the first position.

2. The method according to claim 1, wherein the method further includes the step of controlling the speed of rotation of the pair of drive rollers and the web take-up roll so as to substantially equal the speed of rotation of the first and second applicator rollers.

3. The method according to claim 2, wherein the step of controlling the speed of rotation of the pair of drive rollers and the web take-up roll includes calculating the rotational speed of the applicator rollers, and adjusting the speed of rotation of the drive rollers and the web take-up roll to equal the calculated rotational speed of the applicator rollers.

4. The method according to claim 1, wherein the step of controlling the first applicator roller, the drive rollers, and the web take-up roll includes calculating a first time required to move the first applicator roller from the second position to the first position, calculating a second time required to drive the card into the roller nip, and calculating a third time required to move the one image into the roller nip.

5. The method according to claim 4, further including determining the maximum of said first, second and third times, and controlling the movement of the first applicator roller, the rotation of the drive rollers, and the rotation of the web take-up roll based upon the maximum time.

6. The method according to claim 1, further including the step of vertically registering the card and the receptor web.

7. The method according to claim 6, wherein the step of vertically registering includes forming an index mark on the receptor web, and providing a sensor disposed upstream of the applicator rollers, and using the sensor to sense the index mark.

8. The method according to claim 1, further including the step of correlating the card with the one image on the receptor web.

9. The method according to claim 8, wherein the step of correlating comprises forming a bar code on the receptor web adjacent said one image, and sensing said bar code.

10. An image transfer section of a printer, comprising:

first and second rotatable applicator rollers forming a roller nip therebetween, said first applicator roller being moveable toward and away from the second applicator roller between a first position adjacent the second applicator roller to thereby form the roller nip and a second position remote from the second applicator roller;

a pair of rotatable drive rollers to drive a card into the roller nip of the first and second applicator rollers;

a rotatable receptor web take-up roll, and a receptor web connected to the receptor web take-up roll and extending between the applicator rollers, the receptor web including a plurality of spaced images thereon;

a control system for controlling operation of the image transfer section, said control system including adaptive horizontal registration control means controlling the movement of the first applicator roller from the second position to the first position and controlling the drive rollers and the web take-up roll so that the card and one of said images are driven into the roller nip substantially simultaneously with the first applicator roller reaching the first position.

11. The image transfer section according to claim 10, wherein the control system further includes adaptive speed adjustment control means controlling the speed of rotation of the pair of drive rollers and the web take-up roll so as to substantially equal the speed of rotation of the first and second applicator rollers.

12. The image transfer section according to claim 11, wherein said adaptive speed adjustment control means comprises means for calculating the rotational speed of the applicator rollers, and means for calculating the rotational speeds of the web take-up roll and the drive rollers based upon the calculated rotational speed of the applicator rollers.

13. The image transfer section according to claim 10, wherein said adaptive horizontal registration control means comprises means for calculating a first time required to move the first applicator roller from the second position to the first position, means for calculating a second time required to drive the card into the roller nip, and means for calculating a third time required to move the one image into the roller nip.

14. The image transfer section according to claim 13, wherein said adaptive horizontal registration control means further comprises means for determining the maximum of said first, second and third times, and controlling the movement of the first applicator roller, the rotation of the drive rollers, and the rotation of the web take-up roll based upon the maximum time.

15. The image transfer section according to claim 10, wherein said adaptive horizontal registration control means includes an index mark on the receptor web adjacent the one image, and a sensor disposed upstream of the applicator rollers for sensing the index mark.

16. The image transfer section according to claim 15, wherein said control system further comprises means for vertically registering the card and the one image.

17. The image transfer section according to claim 16, wherein said means for vertically registering comprises the index mark on the receptor web.

18. The image transfer section according to claim 10, wherein said horizontal registration control means includes means for correlating the card with the one image on the receptor web.

19. The image transfer section according to claim 18, wherein said means for correlating comprises a bar code on the receptor web adjacent the one image.

20. A control system controlling an image transfer section having first and second rotatable applicator rollers forming a roller nip therebetween with the first applicator roller being moveable toward and away from the second applicator roller between a first position adjacent the second applicator roller and a second position remote from the second applicator roller, a pair of rotatable drive rollers to drive a card into the roller nip of the first and second applicator rollers, a rotatable receptor web take-up roll having a receptor web connected thereto and extending between the applicator rollers, and a plurality of spaced images on the receptor web, the control system comprising:

adaptive horizontal registration control means controlling the movement of the first applicator roller from the second position to the first position and controlling the drive rollers and the web take-up roll so that the card and one of said images arc driven into the roller nip substantially simultaneously with the first applicator roller reaching the first position.

21. The control system according to claim 20, wherein said adaptive horizontal registration control means comprises means for calculating a first time required to move the first applicator roller from the second position to the first position, means for calculating a second time required to drive the card into the roller nip, and means for calculating a third time required to move the one image into the roller nip.

22. The control system according to claim 21, wherein said adaptive horizontal registration control means further comprises means for determining the maximum of said first, second and third times, and controlling the movement of the first applicator roller, the rotation of the drive rollers, and the rotation of the web take-up roll based upon the maximum time.

23. The control system according to claim 20, wherein the control system further comprises adaptive speed adjustment control means controlling the speed of rotation of the pair of drive rollers and the web take-up roll so as to substantially equal the speed of rotation of the first and second applicator rollers.

24. The control system according to claim 23, wherein said adaptive speed adjustment control means comprises means for calculating the rotational speed of the applicator rollers, and means for calculating the rotational speeds of the web take-up roll and the drive rollers based upon the calculated rotational speed of the applicator rollers.

25. The control system according to claim 20, wherein said adaptive horizontal registration control means includes an index mark on the receptor web adjacent the one image, and a sensor disposed upstream of the applicator rollers for sensing the index mark.

26. The control system according to claim 25, wherein said control system further comprises means for vertically registering the card and the one image.

27. The control system according to claim 26, wherein said means for vertically registering comprises the index mark on the receptor web.

28. The control system according to claim 20, wherein said horizontal registration control means includes means for correlating the card with the one image on the receptor web.

29. The control system according to claim 28, wherein said means for correlating comprises a bar code on the receptor web adjacent the one image.

* * * * *